United States Patent [19]

Kendall

[11] 4,242,564

[45] Dec. 30, 1980

[54] FROST PLUG IMMERSION HEATER AND IMPROVED CLAMPING STRUCTURE

[75] Inventor: Willard E. Kendall, Nashville, Tenn.

[73] Assignee: Budd Canada Inc., Kitchener, Canada

[21] Appl. No.: 956,639

[22] Filed: Nov. 1, 1978

[51] Int. Cl.[3] ..... H05B 3/02; F02N 17/06

[52] U.S. Cl. ..... 219/208; 123/142.5 E; 219/318; 219/336; 220/235; 220/243; 220/248

[58] Field of Search ..... 219/205, 208, 318, 335, 219/336, 536; 123/142.5 R, 142.5 E; 220/243, 247, 248, 251, 323, 325, 326, 235

[56] References Cited

U.S. PATENT DOCUMENTS

| | | | |
|---|---|---|---|
| 682,045 | 9/1901 | De Carlo | 220/326 |
| 1,094,911 | 4/1914 | Lautenbacher et al. | 220/248 |
| 2,037,347 | 4/1936 | Shoop | 220/248 |
| 2,367,909 | 1/1945 | Wanner | 220/243 X |
| 2,579,845 | 12/1951 | McWherter | 220/235 |
| 2,987,283 | 6/1961 | Bleckmann | 219/336 X |
| 3,646,314 | 2/1972 | Windsor | 219/208 |
| 3,766,356 | 10/1973 | Feldmann | 219/208 |

*Primary Examiner*—A. Bartis

*Attorney, Agent, or Firm*—Hill, Van Santen, Steadman, Chiara & Simpson

[57] ABSTRACT

A frost plug immersion heater has improved clamping structure which comprises a clamp element having a base engageable against the inner end of the heater body and a pair of channel-shaped clamping arms narrower than the base extending in splayed relation from opposite sides of the base, with the free ends of the arms initially close enough together so that the heater can be installed straight into a cylinder block core plug hole. A T-shape bolt has a cross arm bar-shaped head which has opposite ends engaging in the arm channels and spreads the clamp arms when a nut threaded on the outer end portion of the bolt shank is tightened against the outer end of the heater body. The cross arm head has a thickened crown area of maximum mass providing a maximum strength portion aligned with the shank of the bolt and the top of the cross arm tapers with diminished mass toward the opposite ends thereof to provide a truss-like reinfocement for the head when force is applied through the bolt shank as the nut is tightened.

3 Claims, 6 Drawing Figures

Fig 1
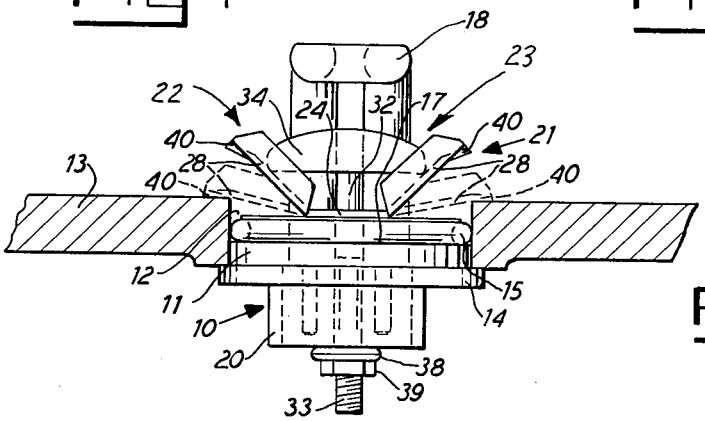
Fig 5
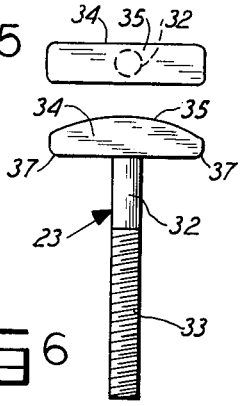
Fig 6
Fig 2
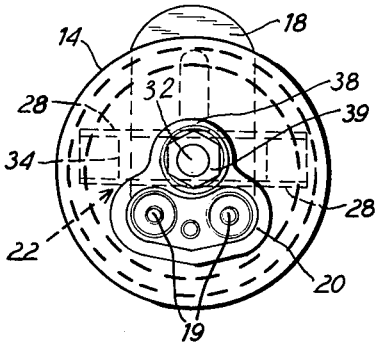
Fig 4
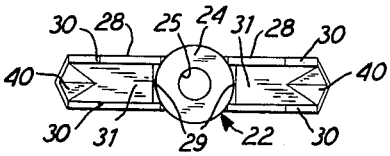
Fig 3
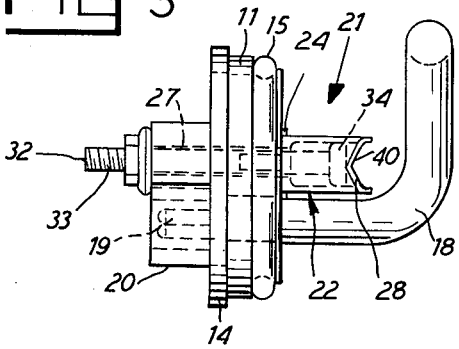

FROST PLUG IMMERSION HEATER AND IMPROVED CLAMPING STRUCTURE

This invention relates to frost plug immersion heaters, and is more particularly concerned with new and useful improvements in the structure for securing the heaters in place in the core plug holes commonly provided in the cylinder blocks of liquid cooled engines.

Electrical frost plug immersion heaters, as such, are well known. Typical examples of such heaters are represented in U.S. Pat. Nos., to Winslow 3,646,314 and to Feldmann 3,766,356 and its Canadian counterpart No. 963,518.

A problem encountered with the arrangement disclosed in said U.S. Pat. No. 3,646,314 is that it provides a rocking or swivel type locking device in order to clamp the heater within the frost plug hole of an engine block. A serious drawback of heaters so equipped is the difficulty involved in installing the same rapidly and easily, especially where the installation is to be effected along a continuously moving factory engine production line. The installing workmen have to become extremely adept at installing heaters so equipped to attain the speed and accuracy required for proper installation. The difficulty is that because the clamping bar is longer in overall length than the diameter of the frost plug hole, the bar must be tilted during installation in order to lead it into the hole. This can be difficult depending on casting wall thickness and internal space limitations within the coolant cavity in the engine block.

A serious problem in respect to the arrangement disclosed in said U.S. Pat. No. 3,766,356 is that the clamping screw is necessarily threaded through the clamping bar, with the head of the screw at the outer side of the heater body. In the first place, the head of the screw is located in a recess in the front end of the body and is thus inconvenient for wrenching during installation. More disadvantageously, if the clamping bar is permitted to become loose relative to the spreadable clamp arms, the two elements can become disoriented and the installer loses control and must pull the plug and reorient the parts and reinstall the same. Also, should the screw be turned too far in the wrong direction, especially to unfasten the heater for replacement, the clamping bar can drop off into the engine block coolant cavity. If there is only a small clearance with a cylinder wall, the screw shank tip may be stopped before full tightening occurs.

It is therefore an important object of the present invention to provide a new and improved frost plug immersion heater, and in particular structure for efficiently securing such a heater in place, and which will overcome the disadvantages, drawbacks, inefficiencies, shortcomings and problems inherent in prior structures.

The invention is embodied in a frost plug immersion heater for liquid cooled engines and which comprises a substantially cylindrical body having inner and outer ends. A electrical heater element extends from said inner end of said body and has means at the outer end of said body for operative connection to a source of electrical energy. Clamping structure for securing said heater in a frost plug hole in an engine block wall comprises an elongate clamp element having a base engageable against said inner end of said body and a pair of clamping arms extending in splayed relation in alignment with each other bendably from opposite sides of said base. The free ends of said arms initially are spaced apart no greater than the diameter of said body but the overall length of said element including said base and said arms is substantially greater than the diameter of said body. A substantially T-shaped bolt has a central shank extending through aligned clearance holes extending through said base and said body, so that a threaded outer end portion of said shank extends from the outer end of said body and a cross arm head rigid on the inner end of said shank engages at its opposite ends with inwardly facing diagonal surfaces of said arms. A nut is threaded on said threaded outer end portion of said shank and thrustingly opposes said outer end of said body. Thereby said body with said clamp element and said bolt assembled therewith can be inserted straight into said frost plug hole until a lateral flange on said body engages an outer side of the engine block wall about said frost plug hole, and then by tightening said nut said cross arm head is drawn toward said inner end of said said body and causes said arms to bend toward said inner end of said body and thereby into engagement with an inner side of said block wall about said frost plug opening to clampingly secure said body in said frost plug opening. The base of the clamp element is of substantially uniform width entirely about the bolt shank clearance hole which extends through the base. The arms of the clamp element are of substantially rigid channel shape, substantially narrower than the base and have longitudinally extending spaced side flanges which project generally inwardly. The cross arm head of the bolt is of generally elongate bar shape and fits between the flanges in the channels of the arms.

Among advantages of the invention are that the heater is adapted to be installed easily by simply inserting it by straight line inward movement into position in the selected frost plug hole of an engine block, and then by tightening the nut on the clamping bolt securing of the heater is completed. The simple two stage rapid installation of the heater thus permits relatively inexperienced installing personnel to effect installation rapidly and efficiently.

Other objects, features and advantages of the invention will be readily apparent from the following description of a representative embodiment thereof, taken in conjunction with the accompanying drawing although variations and modifications may be effected without departing from the spirit and scope of the novel concepts embodied in the disclosure, and in which:

FIG. 1 is a side elevational view of a frost plug immersion heater equipped with the invention, and demonstrates steps in the installing of the heater in an engine block frost plug opening.

FIG. 2 is an outer end plan view of the heater.

FIG. 3 is a side elevational view of the heater taken 90° from the elevation shown in FIG. 1.

FIG. 4 is a top plan view of the bendable clamping member of the heater securing or clamping structure.

FIG. 5 is a top plan view of the T-bolt of the clamping structure; and

FIG. 6 is a side elevational view of the T-bolt.

A frost plug immersion heater 10 embodying the present invention comprises a disk-like cylindrical body 11 of a diameter to be received slideably in a frost plug hole 12 (FIG. 1) in a wall 13 of a liquid cooled engine block. On its outer end, the body 11 has an annular lateral seating flange 14 which engages the outer face of the wall 13 about the opening 12. Adjacent to its inner end, the body 11 carries a sealing O-ring 15 mounted in an annular groove 17 and engaging the wall defining the opening 12 to seal the joint between the body 11 and the wall of the opening against leakage pass the heater body. Projecting inwardly from the body 11 in customary manner is a heater element 18 having prong means 19 at the outer end of the heater body 11, and more particularly an outwardly projecting boss 20 on the body, for connection with an electrical energy source.

New and improved, economical, simple, efficient clamp structure 21 is provided for securing the heater 10 fixedly in place after installation of the heater in the frost plug hole 12. In a preferred construction, the structure 21 comprises a clamp element 22 and a T-bolt 23. The clamp element 22 may be fabricated as a die stamped metal or spring part. The bolt 23 may comprise a mild steel forging.

As fabricated, the clamp element 22 comprises a base 24 of substantial area adapted to lie flat against the inner end of the heater body 11. A central bolt hole 25 through the base 24 is in assembly aligned with a matching bolt hole 27 through the heater body 11. Projecting in alignment from respective opposite sides of the base 24 are clamp arms 28 which join the base 24 along respective bend junctures 29. As fabricated, the arms 28 extend in splayed relation from the base 24 and have their free ends spaced apart no greater than the diameter of the heater body 11. Each of the arms 28 has along each opposite side a reinforcing flange 30 projecting generally inwardly, whereby each of the arms is of substantially channel-shaped cross section with an inner surface 31 extending diagonally relative to the base 24. It should be noted that the base 30 is of substantially uniform width, in a preferably circular form, entirely about the bolt hole 25 and is substantially wider across the axis of the element 22 than the width of the arms 28. Thereby the bolt hole can be of generous diameter to accommodate a bolt shank of maximum diameter for the present purpose, and without sacrificing strength in the base area to resist efficiently bending stresses that may be imposed in the surface for which the clamp structure 21 is intended. Nevertheless, the side flange-reinforced arms of the element are adapted to be of as narrower width as practicable, and as shown, substantially narrower than the base 24. This promotes maximum efficiency in use of material, enabling the clamp element 22 to be formed from minimum material without sacrificing overall effectiveness of the part. In fact, it will be apparent that even though the base 24 is wider than the arms 28, no additional material is required for such width, since the width of the original blank from which the element 22 is formed must be at least as wide as the base 24 to provide material for the flanges 30 to be formed therefrom up along the sides of the inner surface 31 of the channel-shaped cross-section of the arms.

The T-bolt 23 has a central shank 32 of sufficient length to extend through and beyond the aligned bolt holes 25 and 27 in assembly and with a threaded outer end portion 33 of the shank extending from the outer end of the body 11. An elongate bar-like cross arm head 34 rigid on the inner end of the shank 32 is located to engage at its opposite ends with the inwardly facing diagonal surfaces 31 of the clamp element arms 28. In the preferred construction, the head 34 is of a width to engage freely within the channels between the side flanges 30 of the arms 28. In length, the head 34 is dimensioned to engage the splayed clamp arms 28 well beyond the bend junctures 29, desirably above the longitudinal midpoint of each of the arms so that by drawing the head 34 toward the clamp arms 28 efficient bending leverage will be applied to spread the arms apart. For maximum strength with minimum material, the bolt head 34 has its maximum mass in its crown portion 35 aligned with the integral shank 32. From the center of the crown 35, the top of the bolt tapers with diminished mass toward each opposite end providing truss-like reinforcement advantage for the head when force is applied through the shank 32. To facilitate application of force by the head 34 against the diagonal surfaces 31 of the arms 28, the contact or thrust ends of the head 34 are desirably chamfered or rounded to provide thrust cam surface 37 (FIG. 6).

In the assembly, after the clamp element 22 and the bolt 23 have been assembled together and the shank 32 extended through the bolt hole 27, a sealing washer 38 is applied about the bolt shank 32 and a nut 39 threaded onto the threaded portion 33. The heater 10 as a complete assembly is then ready to be installed in the frost plug hole 12. This can be effected by a quick inward maneuver in which the heating element 18 is directed into and through the hole 12 and the heater then pushed straight inwardly into place without any regard to the clamping structure 21 until the stop flange 14 engages with the block wall 13, whereupon the readily accessible nut 39 is tightened, causing the sealing washer 38 to thrust sealingly against the outer end of the boss 20 about the outer end of the bolt clearance bore 27. As the nut 39 is progressively tightened, the cam ends 37 of the bolt cross arm head 34 thrust camingly against the surfaces 31 of the clamp arms 38, causing them to bend about the bend junctures 29 toward and into engagement with the inner side of the engine block wall about the frost plug opening to clampingly secure the body in the frost plug opening 12. To enhance the grip of the free end portions of the arms 28 with the wall 13, central gripper prong terminal projections 40 are desirably formed on the arm ends. It will be appreciated, of course, that the overall length of the clamp element 22 should be calculated to bridge entirely across the frost plug hole 12 for which the heater 10 is designed and sufficiently laterally beyond the sides of the hole when the clamp element is spread out from its initial generally V-shape configuration to attain a thorough clamping grip with the wall 13 under the draw-up pressure exerted by the bolt head 34.

It will be understood that variations and modifications may be effected without departing from the spirit and scope of the novel concepts of this invention.

I claim as my invention:

1. A frost plug immersion heater for liquid cooled engines and comprising a substantially cylindrical body having inner and outer ends, said body being of a size to closely fit into a frost plug hole of an engine block wall and having a lateral flange on its outer end engageable with the engine block wall to limit the movement of the body into the hole, a sealing gasket around the peripheral surface of said body for sealing the gap between the body and the surface of the frost plug hole, an electrical heater element extending from said inner end of said body and having means at the outer end of said body for operative connection to a source of electrical energy, and clamping structure for securing said heater in a frost plug hole in an engine block wall, said clamping structure comprising:

an elongate clamp element having a base engageable against said inner end of said body and a pair of integral arms extending in splayed relation in alignment with each other bendably from opposite sides of said base, with the free ends of said arms initially spaced apart no greater than the diameter of said body but the overall length of said element including said base and said arms being substantially greater than the diameter of said body;

a substantially T-shaped bolt having a central shank extending through aligned clearance holes in said base and said body, so that a threaded outer end portion of said shank extends from the outer end of said body, and an elongate cross arm head rigid on the inner end of said shank engaging at its opposite ends with inwardly facing diagonal surfaces of said arms;

said cross arm head having a thickened crown area of maximum mass providing a maximum strength portion aligned with said shank, the top of said cross arm tapering with diminished mass toward each opposite end to provide truss-like reinforcement for the cross arm head when force is applied through said central shank; a nut threaded on said threaded outer end portion of said shank and thrustingly opposing said outer end of said body;

and a sealing ring between said nut and said body for sealing the outer end of the hole in said body;

said base being substantially flat and engaging a substantially flat area on said inner end of said body about said clearance hole in said body;

said arms being intergrally attached to said base along bend lines enabling the arms to bend towards said inner end of said body and toward the block wall by thrusting action of said cross arm head against said arms, and being of substantially rigid channel-shape and substantially narrower than said base and having longitudinally extending spaced side flanges which project generally inwardly;

said cross arm head being of generally elongate solid bar shape fitting between said flanges in the channels of said arms;

whereby said body with said clamp element and said bolt assembled therewith can be inserted straight into said frost plug hole until said lateral flange on the outer end of said body engages an outer side of the engine block wall about said frost plug hole, and then by tightening said nut said cross arm head is drawn toward said inner end of said body and causes said arms to be bent toward said inner end of said body and thereby into engagement with an inner side of said block wall about said frost plug opening to clampingly secure said body in said frost plug opening.

2. A frost plug immersion heater for liquid cooled engines and comprising a substantially cylindrical body having inner and outer ends, said body being of a size to closely fit into a frost plug hole of an engine block wall and having a lateral flange on its outer end engageable with the engine block wall to limit the movement of the body into the hole, a sealing gasket around the peripheral surface of said body for sealing the gap between the body and the surface of the frost plug hole, an electrical heater element extending from said inner end of said body and having means at the outer end of said body for operative connection to a source of electrical energy, and clamping structure for securing said heater in a frost plug hole in an engine block wall, said clamping structure comprising:

an elongate clamp element having a base engageable against said inner end of said body and a pair of integral arms extending in splayed relation in alignment with each other bendably from opposite sides of said base, with the free ends of said arms initially spaced apart no greater than the diameter of said body but the overall length of said element including said base and said arms being substantially greater than the diameter of said body;

a substantially T-shaped bolt haing a central shank extending through aligned clearance holes in said base and said body, so that a threaded outer end portion of said shank extends from the outer end of said body, and an elongate cross arm head rigid on the inner end of said shank engaging at its opposite ends with inwardly facing diagonal surfaces of said arms;

a nut threaded on said threaded outer end portion of said shank and thrustingly opposing said outer end of said body;

said arms being of substantially rigid channel shape having longitudinally extending spaced side flanges which project generally inwardly;

said cross arm head being of generally elongate solid bar shape fitting between said flanges in the channels of said arms;

said opposite ends of said cross arm head having surfaces thrusting against said diagonal surfaces of said arms;

said cross arm head having a thickened crown area of maximum mass providing a maximum strength portion aligned with said shank, and the top of said cross arm tapering with diminished mass towards each opposite end of said head to provide truss-like reinforcement for the cross arm head when force is applied through said central shank;

said clamp element comprising a stamped metal structure;

a sealing ring about said bolt shank and interposed between said nut and said outer end of said body;

said clamp element base being substantially flat and wider than said clamp element arms and engaging a substantially flat area on said inner end of said body about said clearance hole in said body;

said clamp element arms being longitudinally rigid and integrally attached to said base along lines enabling the arms to be bent toward said inner end of said body and toward the block wall by thrusting action of said cross arm head arms against said clamp element arms;

and each of said clamp element arms having on its free end means for enhancing gripping engagement with the inner side of the block wall;

whereby said body with said clamp element and said bolt assembled therewith can be inserted straight into said frost plug hole until the lateral flange on said body engages an outer side of the engine block wall about said frost plug hole, and then by tightening said nut said cross arm head is drawn toward said inner end of said body and causes said clamp element arms to be bent toward said inner end of said body and thereby into engagement with an inner side of said block wall about said frost plug opening to clampingly secure said body in said frost plug opening.

3. A frost plug immersion heater according to claim 2, wherein said clamp element base is substantially circular.

* * * * *